US011134323B2

(12) United States Patent
Mietta et al.

(10) Patent No.: US 11,134,323 B2
(45) Date of Patent: Sep. 28, 2021

(54) COMPONENT FOR DRAINING OFF WATER FROM THE SPEAKERS OF A WATERPROOF ELECTRONIC DEVICE

(71) Applicant: SAATI S.P.A., Appiano Gentile (IT)

(72) Inventors: Marco Mietta, Appiano Gentile (IT); Carmine Lucignano, Appiano Gentile (IT); Roberto Momente', Appiano Gentile (IT); Vasco Marelli, Appiano Gentile (IT); Marco Mauri, Appiano Gentile (IT); Martina Simone, Appiano Gentile (IT); Elisa Grimoldi, Appiano Gentile (IT); Massimiliano Battistelli, Appiano Gentile (IT); Paolo Canonico, Appiano Gentile (IT)

(73) Assignee: SAATI S.P.A., Appiano Gentile (IT)

( * ) Notice: Subject to any disclaimer, the term of this patent is extended or adjusted under 35 U.S.C. 154(b) by 57 days.

(21) Appl. No.: 16/635,939

(22) PCT Filed: Jul. 11, 2018

(86) PCT No.: PCT/IB2018/055116
§ 371 (c)(1),
(2) Date: Jan. 31, 2020

(87) PCT Pub. No.: WO2019/025885
PCT Pub. Date: Feb. 7, 2019

(65) Prior Publication Data

US 2021/0152903 A1 May 20, 2021

(30) Foreign Application Priority Data

Aug. 1, 2017 (IT) ..... 102017000088405
Mar. 1, 2018 (IT) ..... 102018000003169

(51) Int. Cl.
*H04R 1/00* (2006.01)
*H04R 1/02* (2006.01)
*H04R 1/44* (2006.01)

(52) U.S. Cl.
CPC ..... *H04R 1/023* (2013.01); *H04R 1/025* (2013.01); *H04R 1/028* (2013.01); *H04R 1/44* (2013.01); *H04R 2499/11* (2013.01)

(58) Field of Classification Search
CPC ..... H04R 3/007; H04R 1/083; H04R 1/10; H04R 3/04; H04R 2410/07; H04R 1/44;
(Continued)

(56) References Cited

U.S. PATENT DOCUMENTS

2015/0319534 A1 11/2015 Lippert et al.
2016/0037243 A1* 2/2016 Lippert ..... H04R 1/086 381/166
2016/0052017 A1 2/2016 Weber et al.

FOREIGN PATENT DOCUMENTS

CN 204993740 U 1/2016
WO 2010/122556 A1 10/2010
(Continued)

OTHER PUBLICATIONS

International Preliminary Report on Patentability dated Oct. 22, 2019.
(Continued)

*Primary Examiner* — Amir H Etesam
(74) *Attorney, Agent, or Firm* — Hedman & Costigan, P.C.; James V. Costigan; Kathleen A. Costigan

(57) ABSTRACT

A shaped component made of technical fabric for protection of the speakers of electronic devices with waterproofing characteristics of IPx7 degree or higher, which have water-tight speakers. In addition to the function of protection from solid particles, the invention is optimised for guaranteeing
(Continued)

fast and efficient draining-off of the water that has penetrated into the water-tight speaker so as to recover as fast as possible the initial acoustic functionality, in an improved way as compared to the solutions currently available. The component according to the present invention comprises within it one or more openings covered by synthetic technical fabric with hydrophilic treatment, to guarantee rapid exit of the water that has entered the speaker module, and one or more openings covered by synthetic technical fabric with hydrophobic treatment, to favour entry of air into the volume in front of the speaker, thus ensuring proper emptying thereof. In detail, among the various possible embodiments, the present invention may be implemented as a multilayer die-cut part that combines a hydrophilic synthetic fabric with a hydrophobic synthetic fabric and with one or more layers of adhesive to enable assembly inside the end products.

18 Claims, 16 Drawing Sheets

(58) Field of Classification Search
CPC ..... H04R 1/04; H04R 1/2876; H04R 1/02; H04R 31/00
See application file for complete search history.

(56) References Cited

FOREIGN PATENT DOCUMENTS

| | | | |
|---|---|---|---|
| WO | 2011/132062 | A1 | 10/2011 |
| WO | 2014/037755 | A1 | 3/2014 |
| WO | 2017/060765 | A2 | 4/2017 |

OTHER PUBLICATIONS

International Preliminary Report on Patentability(Replaced) dated Nov. 12, 2019.
International Search Report dated Oct. 22, 2018.
Written Opinion of the International Searching Authority dated Oct. 12, 2018.
English Abstract of CN 204993740 dated Jan. 20, 2016.

* cited by examiner

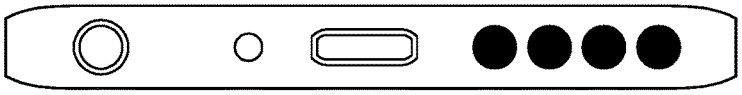
FIG.5
PRIOR ART
FIG.6
PRIOR ART
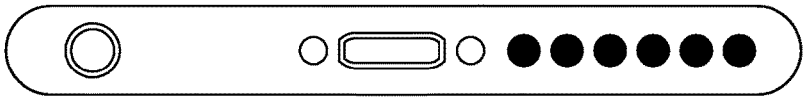
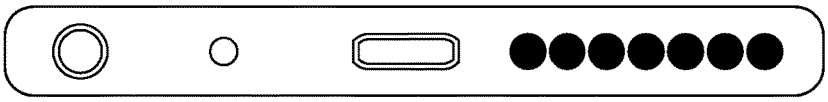
FIG.7
PRIOR ART
FIG.8
PRIOR ART
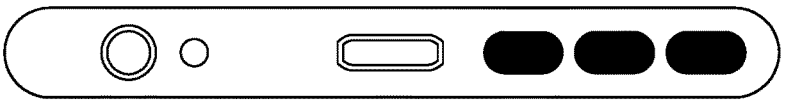
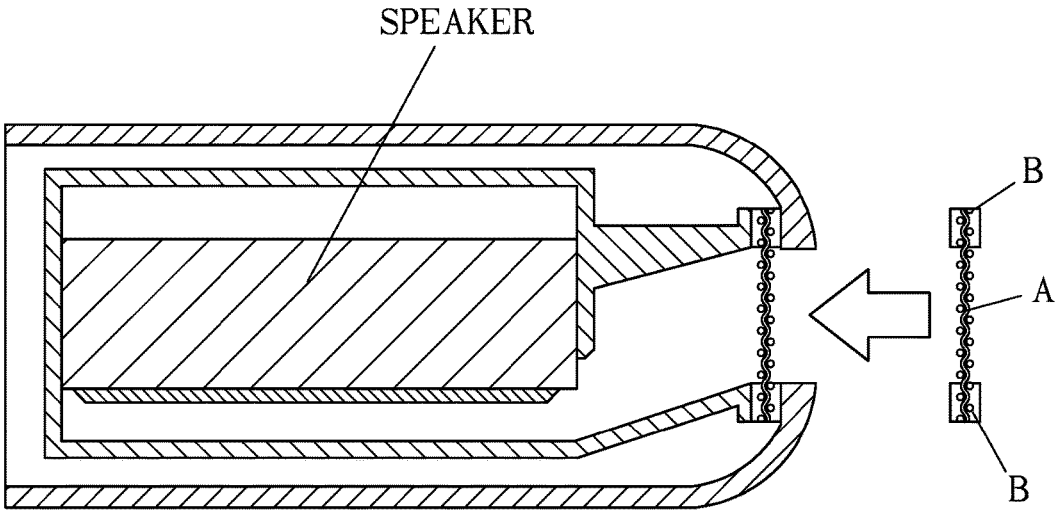
FIG.9
PRIOR ART

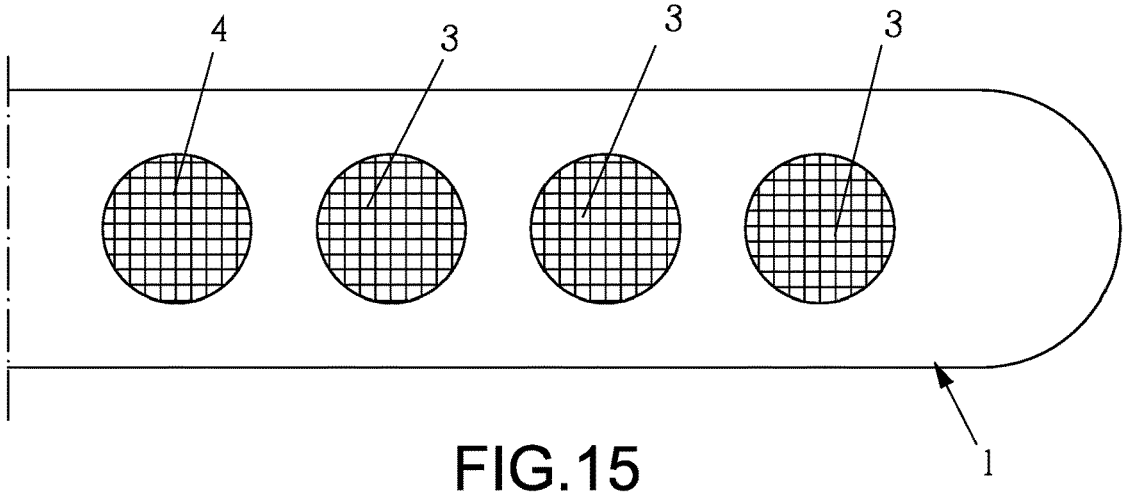
FIG.15
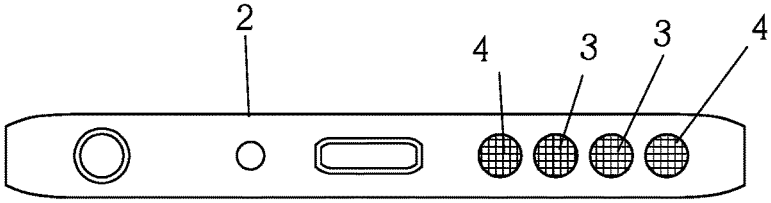
FIG.16
FIG.17
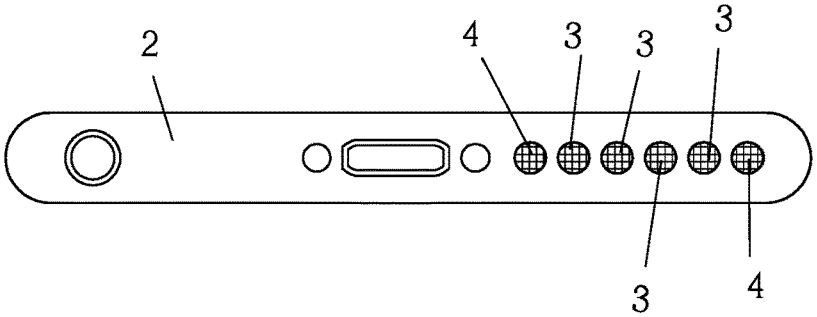
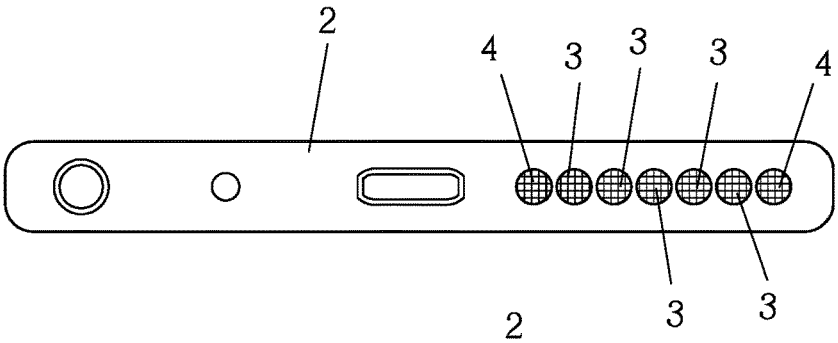
FIG.18
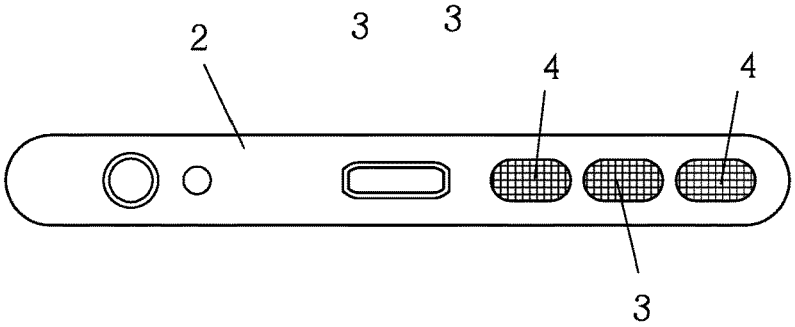
FIG.19

COMPONENT FOR DRAINING OFF WATER FROM THE SPEAKERS OF A WATERPROOF ELECTRONIC DEVICE

The subject of the present invention is a component having the function of draining off water from the speakers of a waterproof electronic device.

The subject of the present invention is, in particular, a shaped component made of hydrophilic and hydrophobic technical fabric having the function of draining off water from the speakers of waterproof smartphones and electronic devices in general.

BACKGROUND OF THE INVENTION

The world of mobile phones and smartphones by now offers devices having a high resistance to penetration of water. In various cases, protection is also guaranteed in the case of complete and prolonged immersion, with a degree of protection equal to or higher than IP67, i.e., immersion in water at the depth of 1 m for 30 minutes.

To obtain this level of performance, various solutions are implemented for the complete sealing of the outer shell of the device, but it is equally important to guarantee protection of the acoustic components, such as speakers and microphones, represented in FIG. 1 and designated, respectively, by the references A and B.

For their very function, these components necessarily impose the need for openings in the shell of the phone, with the consequent requirement of providing water-tightness also in these areas.

Currently, microphones impose the need to protect the corresponding openings with waterproof acoustic materials, such as membranes of a particular type, which are able to guarantee an acceptable transmission of sound, while maintaining perfect sealing of the internal volume of the device.

For speakers, the situation is completely different: there exist in fact particular water-tight micro-speakers that guarantee complete waterproofing at the level of the diaphragm of the speaker and of the corresponding suspension. In this way, external openings (the so-called sound ports) may be used that are less protected and are not water-tight, thanks to the water-tightness guaranteed at the level of the component itself.

Typically, the external sound port of a smartphone is obtained as illustrated in FIG. 2, which shows a cross-sectional view of installation of the module of a loudspeaker A. The external sound port B is normally protected by a simple open-mesh technical fabric C, of a synthetic monofilament type, which enables optimal acoustic performance thanks to its light and open structure, this being rendered possible by the fact that the water-tight function is entrusted to the innermost component, namely, to the diaphragm D of the speaker.

By so doing, manufacturers of phone devices with IP67 or IP68 degree of protection implicitly accept that all the volume E in front of the speaker is filled with the water F coming from outside whenever the phone is immersed.

Evidently, this small amount of liquid does not jeopardise integrity of the device, thanks to the waterproofing of the speaker itself, but problems may arise at the moment of re-use of the speaker after water has penetrated.

Normally, it is expected that the end user will apply some vigorous shaking in the longitudinal direction to get the residual water present inside the module of the speaker to exit from the sound port, but the effects are somewhat random, and the speaker does not always recover its functionality immediately, so that the phone is not efficient or is altogether unusable until the water inside has evaporated completely or until a more vigorous removal action of the liquid has been carried out.

Currently, the problem does not have a definitive solution and constitutes a drawback acknowledged by numerous manufacturers of smartphone and mobile-phone devices.

In general, a smartphone possesses two different speakers, as already illustrated in FIG. 1.

These two speakers, which are both water-tight in the case of an IP67 or IP68 device, are the so-called loudspeaker, which has a hands-free function, and the so-called earpiece, which, instead, emits the sound in the proximity of the ear of the user for normal phone calls.

For the loudspeaker, all smartphones of the prior art by now have a "side-firing" configuration, where the sound produced by the loudspeaker arranged horizontally passes through a side channel (whence the term "side-firing") and is emitted from a sound port in the proximity of the bottom edge of the device.

FIG. 3 exemplifies this concept by comparing the current constructional solution with the prior "rear-firing" configuration, illustrated in FIG. 4, used for first-generation mobile phones.

It is evident that this contorted configuration, with a long and narrow channel having sections of passage of just 10-15 $mm^2$, is all the more problematical as regards ease of removal of the water that has penetrated. Removal of the water is simpler for a typical earpiece, which has the sound port in the immediate vicinity of the speaker, in a way very similar to the old rear-firing loudspeaker configuration; for this reason, the side-firing loudspeaker configuration is the one more in need of high efficiency of removal of the water.

Typically, the sound port of the loudspeaker of a smartphone is constituted by a series of holes or openings on the bottom edge of the device, in a number ranging from 3 to 8, with a total section of passage of between 5 and 15 $mm^2$ as a typical value. FIGS. 5-8 illustrate various examples of sound ports of conventional smartphones.

The sound port is normally protected via a synthetic monofilament based fabric mesh, which is effective against entry of dust and possibly of splashes of liquid, but not of water under pressure as in the case of immersion of the device.

In the most common constructional configuration, the synthetic fabric is incorporated in a dinked or die-cut part, exemplified in FIGS. 9-11. In this part, the protective synthetic fabric A is provided along its perimeter with a double biadhesive layer B so that it can be mounted providing a seal between the outer shell of the phone and the internal speaker module. In the most common configuration, the die-cut part has an oval or rectangular shape, with the adhesive along the entire perimeter and the technical fabric in an internal position according to a markedly elongated oval shape so as to cover all the openings for exit of the sound (see the previous examples in FIGS. 5-8). Typically, the exposed area of the technical fabric has dimensions that range between 10×1 mm and 18×2 mm.

On IP67 waterproof devices, frequently it is precisely the die-cut part that creates the greatest difficulties for discharge of the water when the phone is recovered after accidental immersion. In fact, the technical fabric mounted in the die-cut part presents a certain resistance to entry of water so that the overpressure caused by manual shaking of the device is not always sufficient to cause the liquid to flow over the die-cut part and exit.

For uses in mobile phones, synthetic monofilament based technical fabrics are normally available with mesh apertures of a size of between 20 and 200 μm and possibly available with hydrophobic surface treatment, which is resistant to splashing but not to immersion; in fact, for these materials, the pressure of entry never reaches 1 m of column of water, necessary for IP67 certification.

Even though it is not common practice, in order to improve the draining of water from the speaker module, a monofilament based technical fabric with hydrophilic surface treatment could, instead, be used, with a pressure of entry of water close to zero, which could cause the water to flow out spontaneously even with minimal movement of the device.

This assumption, which is valid in theory, does not, however, apply in practice on account of the particular configuration of the speaker module, exemplified in the cross-sectional view of FIG. 12. In fact, the water is trapped within a closed volume A, which includes the volume in front of the speaker (front volume) and the sound-emission channel. This volume is confined between the die-cut part B, the water-tight diaphragm C of the speaker, and the rigid walls D that define the speaker module.

After immersion of the device, the entire volume A referred to above is likely to be full of water, and it will be necessary to drain the water off, causing exit thereof through the die-cut part.

As is known, to empty liquid out of a closed space it is necessary to introduce therein air, which will take the place of the water that has been expelled. As illustrated in FIG. 13, through the die-cut part A, it is necessary for air to enter (flow B) in order to guarantee exit of the water (flow C).

Precisely in this situation there emerge difficulties deriving from the use of a hydrophilic fabric inside the die-cut part. In fact, this fabric will by definition be very wettable, and will be covered instantaneously by a film of water, which in practice will prevent passage of air through the meshes of the fabric itself, with the consequence that it will not even be easy for the water to come out. Use of a hydrophilic fabric in the die-cut part of an IP67 device will hence provide a rather low contribution to draining of the water that remains inside after immersion.

The foregoing is demonstrated by an actual experiment, described in the section "Practical implementation: exemplary case with experimental results".

In conclusion, there are no real advantages in draining the water from the speaker module either in the case of the die-cut part being made of technical fabric without surface treatment, or in the case of it being made of hydrophobic technical fabric, or in the case of it being made of hydrophilic technical fabric. The latter case in principle could provide advantages, but in actual fact the contraindications linked to the closed volume markedly limit use thereof.

US2016/037243 describes a sound port covered with a mesh and/or other structure that resists entry of liquid and/or of other materials into the acoustic device. Two openings of the casing, separated by an umbrella section, are coupled to the sound port in such a way that the umbrella section covers the sound port. In this way, when the liquid enters one of the openings, the umbrella section can direct the liquid far from the mesh so as to reduce the pressure of the liquid on the mesh. The surface of the mesh and other elements of the sound port can be coated with a hydrophobic and/or hydrophilic coating. However, as illustrated above, the presence of just the hydrophobic coating limits draining, whereas the addition of the hydrophilic coating does not in practice favour draining.

WO2017/060765 describes a method for coupling two layers of a precision fabric to provide a double textile structure, for application to speakers and microphones of electronic devices in general with at least one acoustic function and for protection of the electronic device from water and solid particles that might penetrate therein. The method comprises coupling of the two layers via gluing material sprayed on the synthetic monofilaments of at least one of the two layers of fabric.

WO2010/122556 describes a method for manufacturing flat loudspeakers comprising fabrication of a flat loudspeaker, which includes at least one array of micro-speakers, having a first main surface and a second main surface; at least one of the two surfaces is covered by a coating element comprising an airtight thin film of polymer transparent to an acoustic-pressure wave.

CN204993740 describes a covering for an acoustic module, which comprises an outwards facing side having hydrophobic characteristics.

To date, the problem of efficient removal of water from speaker modules of waterproof phone devices of IP67 or IP68 degree remains largely unsolved.

SUMMARY OF THE INVENTION

The aim of the present invention is to provide a component having the function of draining water from the speakers of a waterproof electronic device that will overcome the drawbacks of the prior art mentioned above.

In this framework, an object of the invention is to provide a component made of technical fabric arranged at the output of the speaker module, in a position corresponding to the sound port on the outer shell, typically provided in the form of a die-cut part with adhesive seal along the perimeter.

The above and other objects, which will become more apparent hereinafter, are achieved by a component having the function of draining off water from the speakers in a waterproof electronic device, characterized in that it comprises a synthetic technical fabric having areas with different degrees of wettability.

The invention regards the component made of technical fabric set at the output of the speaker module, in a position corresponding to the sound port on the outer shell, typically provided in the form of a die-cut part with adhesive seal along the perimeter.

The innovation consists in having in one and the same component both a section of passage with technical fabric having hydrophilic characteristics and a section of passage with hydrophobic material.

BRIEF DESCRIPTION OF THE DRAWINGS

Further characteristics and advantages of the present invention will become more apparent from the description of a preferred, though not exclusive, embodiment of the invention, illustrated by way of non-limiting example in the attached drawings, wherein:

FIGS. 5-8 illustrate various examples of sound ports of conventional smartphones;

FIG. 9 is a cross-sectional view of a conventional smartphone provided with a die-cut part for protection of a sound port;

FIG. 15 is a front view of the sound port of a loudspeaker of a side-firing type of a common smartphone, behind which the component according to the present invention is installed;

FIGS. 16-19 illustrate smartphones with different possible geometries of the holes of the sound port, behind which the component according to the present invention is applied;

DESCRIPTION OF THE PREFERRED EMBODIMENTS

Figure 1:
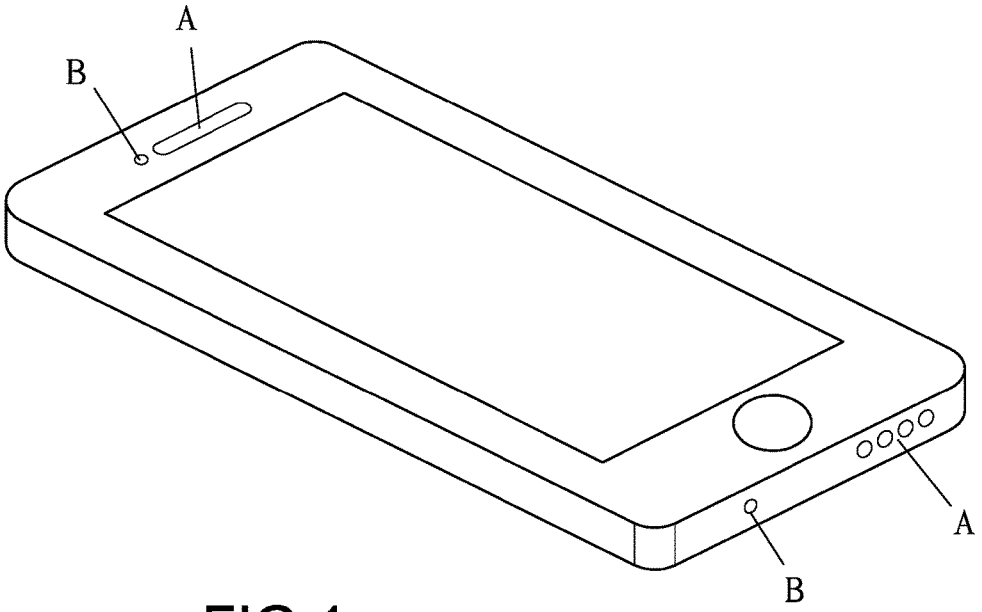
FIG.1 PRIOR ART
FIG. 1 is a perspective view illustrating a conventional smartphone.

With particular regard to the reference numbers of FIGS. 14-28, the component according to the invention, generally designated by the reference numeral 1, is inserted in a smartphone 2 at the openings of a sound port.

Figure 14:
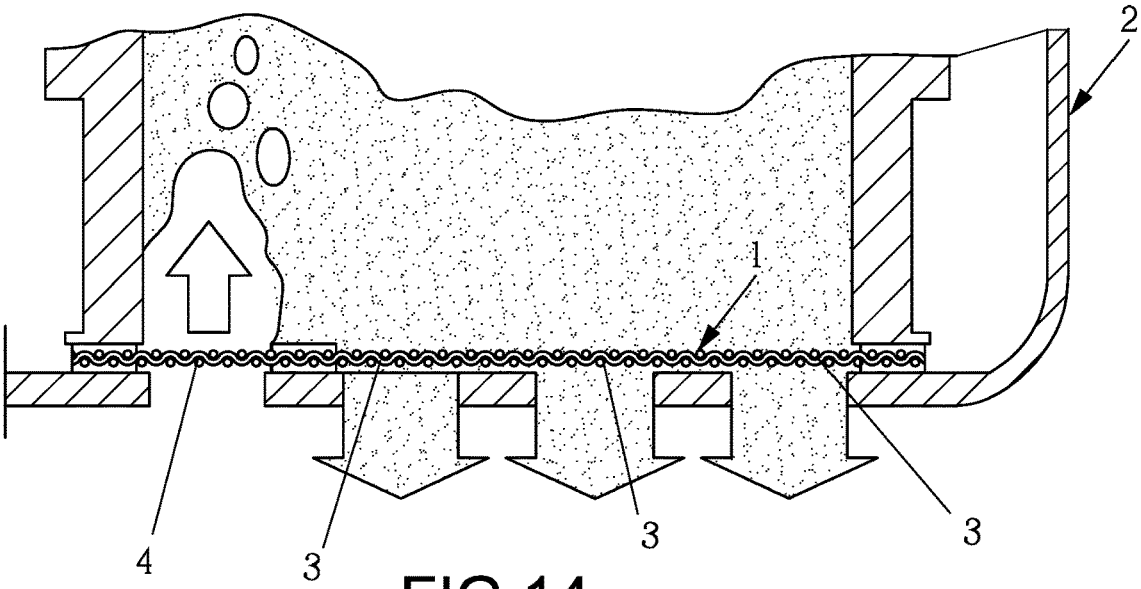
FIG. 14 is a partial sectional view of a smartphone, in a plane parallel to the display of the smartphone, in which the component according to the present invention is sectioned in the direction of its major dimension.

FIG. 14 illustrates the area of the sound port of a smartphone in a view sectioned according to a plane parallel to its display, in which the component 1 is sectioned in the direction of its major dimension.

According to the present invention, the component 1 is a die-cut part which has two or more openings (four, in the case illustrated in the figure), separated from one another by the continuous areas of biadhesive tape and provided with a protective fabric with different surface treatment.

Of these, one or more openings, designated by the reference numeral 3, are provided with a technical fabric of a hydrophilic nature, whereas one or more openings, designated by the reference numeral 4, are protected by technical fabric having hydrophobic characteristics.

In this way, during removal of the water by shaking, the liquid will tend to come out through the openings 3 with the hydrophilic fabric, whereas the hydrophobic area 4 will tend to remain dry and favour entry of the air into the speaker module, markedly favouring outflow of the water.

This geometrical configuration is possible in all the cases where the device has not just one hole, but a number of holes in the region of the sound port of the side-firing loudspeaker. This configuration comprises the vast majority of smartphones and tablets currently present on the market.

Examples of possible geometries are illustrated in FIGS. 16-19, which exemplify the holes behind which the hydrophilic fabric 3 is to be applied and the ones behind which the hydrophobic fabric 4 is to be applied.

Given the normal movement exerted by a person's arm when holding a smartphone, it is preferable for the holes covered by the hydrophobic material 4 to be the ones furthest away from the area in which the liquid will tend to flow owing to its inertia. Typically, the hydrophobic area 4 is positioned in one or both of the laterally outermost positions, as in all the cases illustrated in FIGS. 16-19.

Even though the holes of the sound port are more than one (typically from 3 to 8), the underlying die-cut part 1 is preferably just one for reasons of ease of assembly and proper sealing of the adhesive. Consequently, as envisaged by the present invention, the die-cut part 1 comprises, in a single piece, areas of passage with both hydrophilic and hydrophobic functions, via the use of two different fabrics set alongside one another, which have the aforesaid characteristics of wettability or water-repellence.

Normally, it is very difficult to position the two fabrics precisely in a configuration where they are set side-by-side in a die-cut part of small dimensions, such as the ones typical of the devices in question.

This difficulty is linked to the very small distance between two contiguous holes, which is just 0.5-1 mm in the majority of devices.

To overcome this problem, the present invention envisages an alternative embodiment, optimised for use of two different textile materials, without problems of mutual dimensional interference.

In practice, a die-cut part is envisaged made up of five layers set on top of one another: three layers of adhesive, between which two layers of technical fabric are set, one of which is hydrophilic and the other hydrophobic. In each of the openings one or other of the fabrics will be previously removed by dinking so as to leave for each sound port just one function (either hydrophilic or hydrophobic) according to the fabric present.

Figure 20:
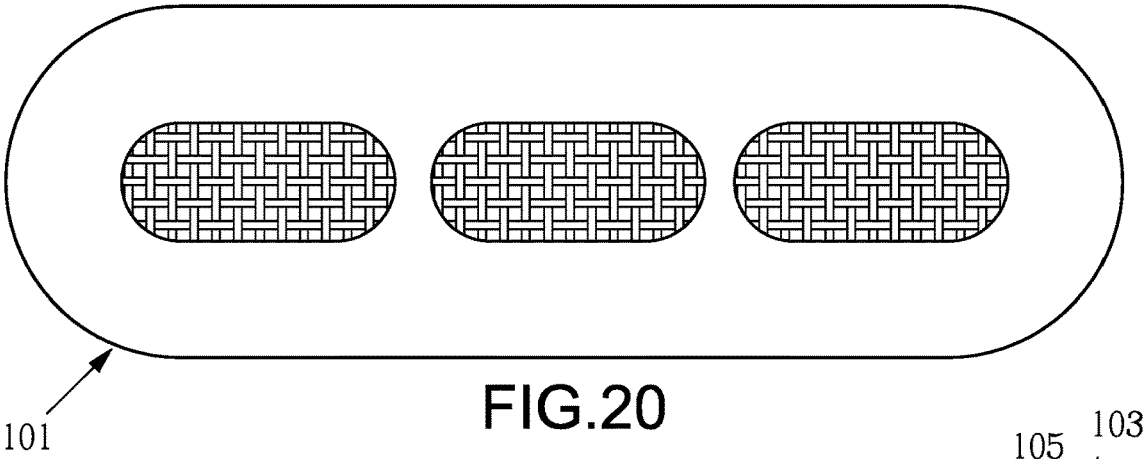
FIG. 20 is a front view of an example of embodiment of the component according to the present invention.
Figure 21:
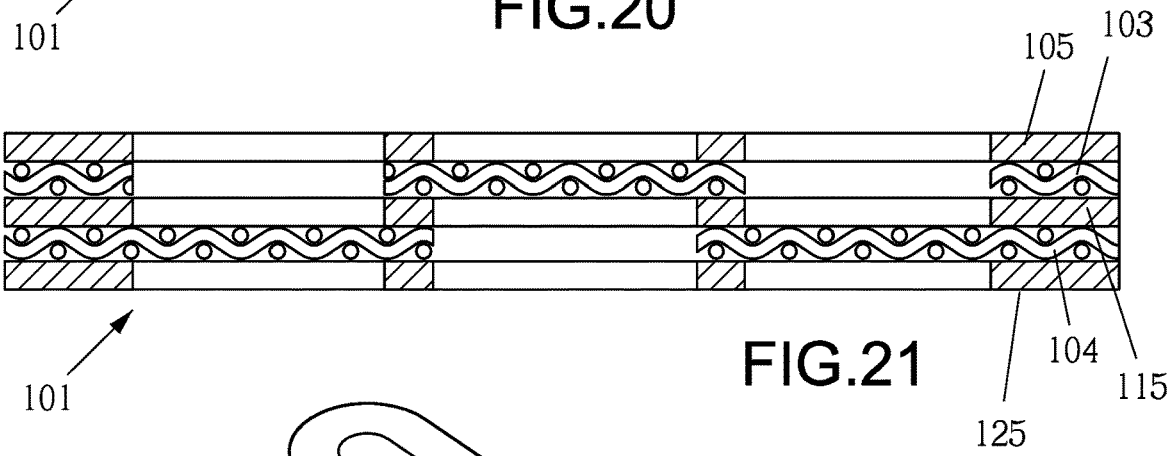
FIG. 21 is a cross-sectional view of the component of the previous figure.

FIG. 20 is a front view of an example of embodiment of a die-cut part 101 according to the present invention, whereas FIG. 21 is a cross-sectional view of the die-cut part 101.

The die-cut part 101 illustrated may be applied to a smartphone provided with a triple sound port with three sections of passage of 3.5×1.5 mm each, one of which has hydrophilic characteristics (enabling exit of the water), whereas the other two have hydrophobic characteristics (favouring entry of air to compensate for the water flowing out).

Figure 22:
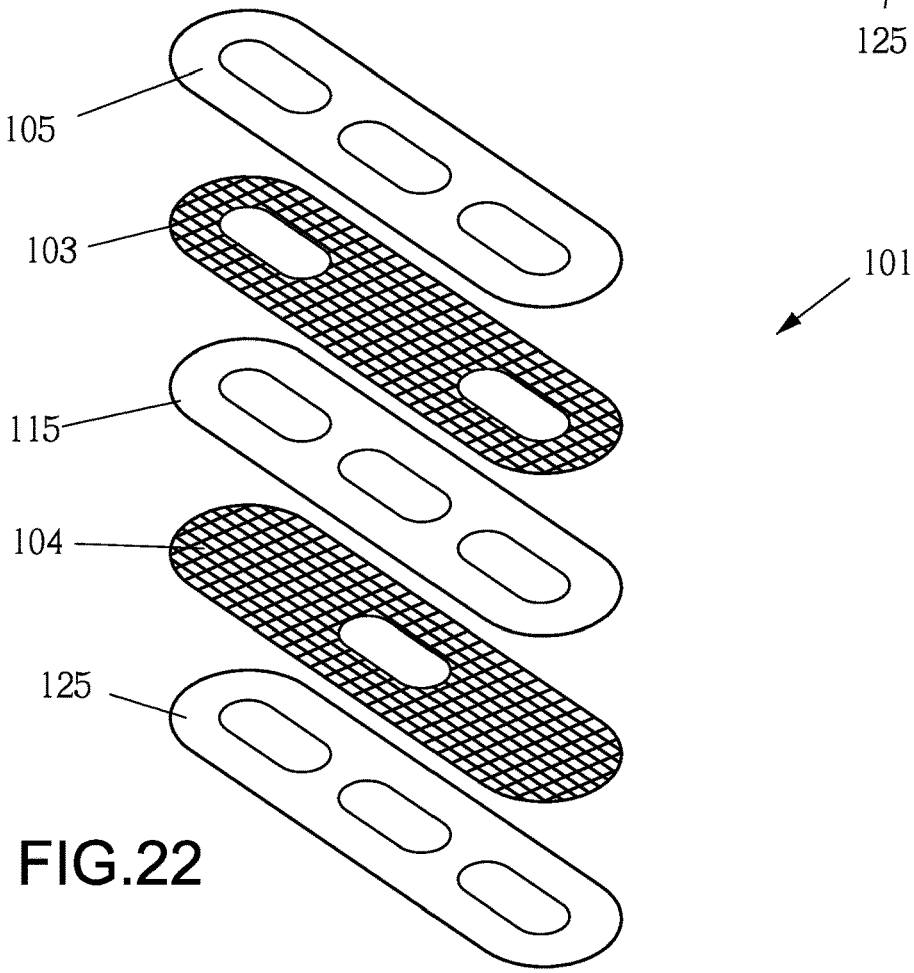
FIG. 22 is an exploded view of the component of the previous figure.

FIG. 22 is an exploded view of the die-cut part 101, where the dinked shapes of the various elements are highlighted.

The die-cut part 101 of FIGS. 20-22 comprises a first outer biadhesive layer 105, normally PSA (pressure-sensitive adhesive), with a thickness of between 0.05 mm and 0.25 mm, to cover the contour of the piece, leaving the three internal openings free.

A layer of synthetic monofilament based technical fabric with hydrophilic characteristics 103, obtained via coating or other surface treatment, with mesh apertures having a size of between 20 and 300 μm, is appropriately dinked so as to cover only the central opening among the three openings present.

An intermediate biadhesive layer 115 has characteristics similar to those of the first outer layer 105.

A layer of synthetic monofilament based technical fabric with hydrophobic characteristics 104, obtained via coating or other surface treatment, with mesh apertures having a size of between 20 and 300 μm, is appropriately dinked so as to cover only the two lateral openings among the three openings present.

A second outer biadhesive layer 125 has characteristics similar to those of the first outer layer 105 and of the intermediate layer 115.

The configuration referred to above can be adapted both according to the number of the sound ports of the specific device and according to the conformation of the other parts of the phone device, i.e., the speaker module and the outer shell.

In particular, it may have a more complex shape or open surfaces that are spaced further apart from one another within the die-cut part 101, if necessary to obtain coincidence with the particular sound ports present on the outer body of the device.

Figure 23:
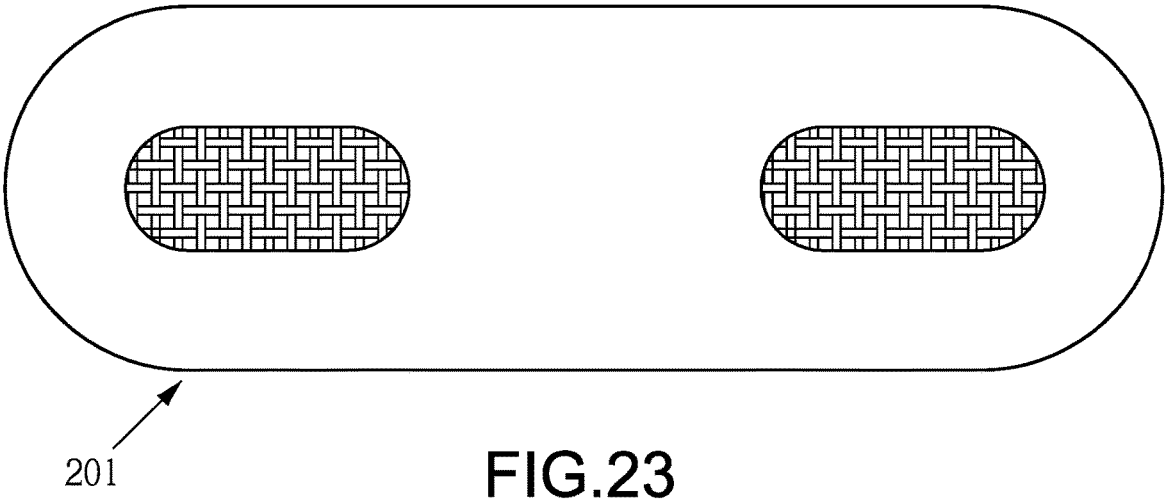
FIG. 23 is a front view of a further example of embodiment of the component according to the present invention.
Figure 24:
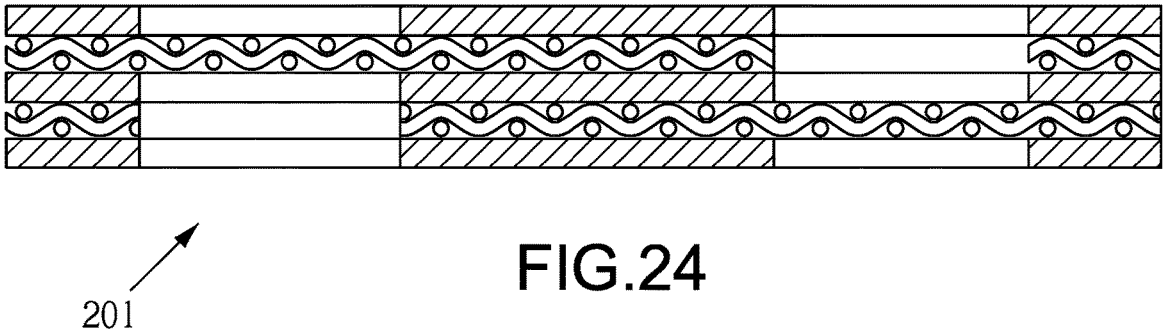
FIG. 24 is a cross-sectional view of the component of the previous figure.
Figure 25:
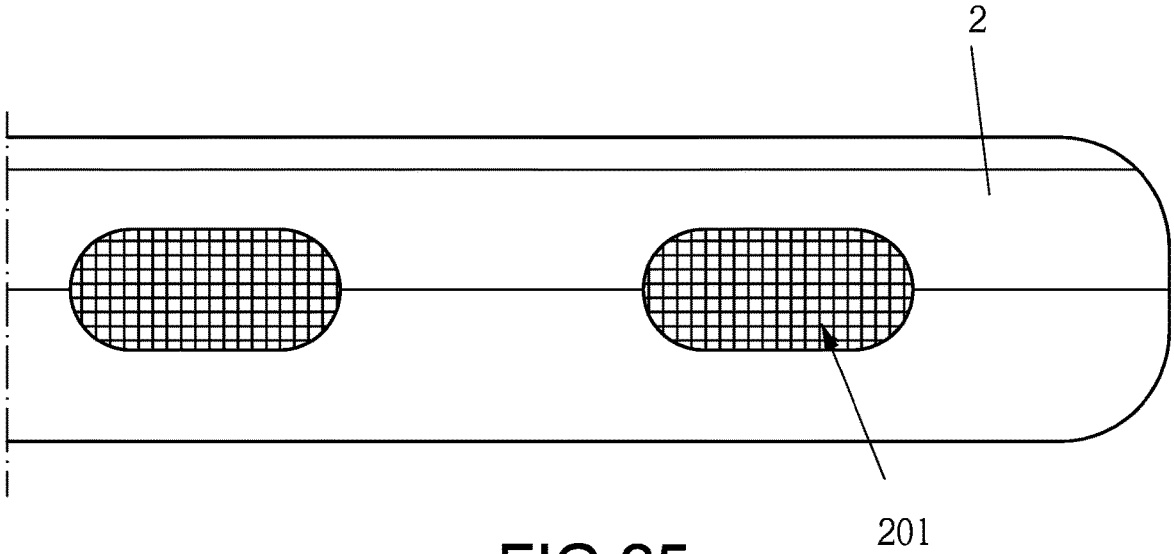
FIG. 25 is a front view of the port of a loudspeaker of a side-firing type of a common smartphone, with two openings spaced apart from one another, behind which the component according to FIGS. 23 and 24 is installed.

For instance, FIGS. 23-25 show a die-cut part 201 adapted for application in the case of just two openings.

Figure 26:
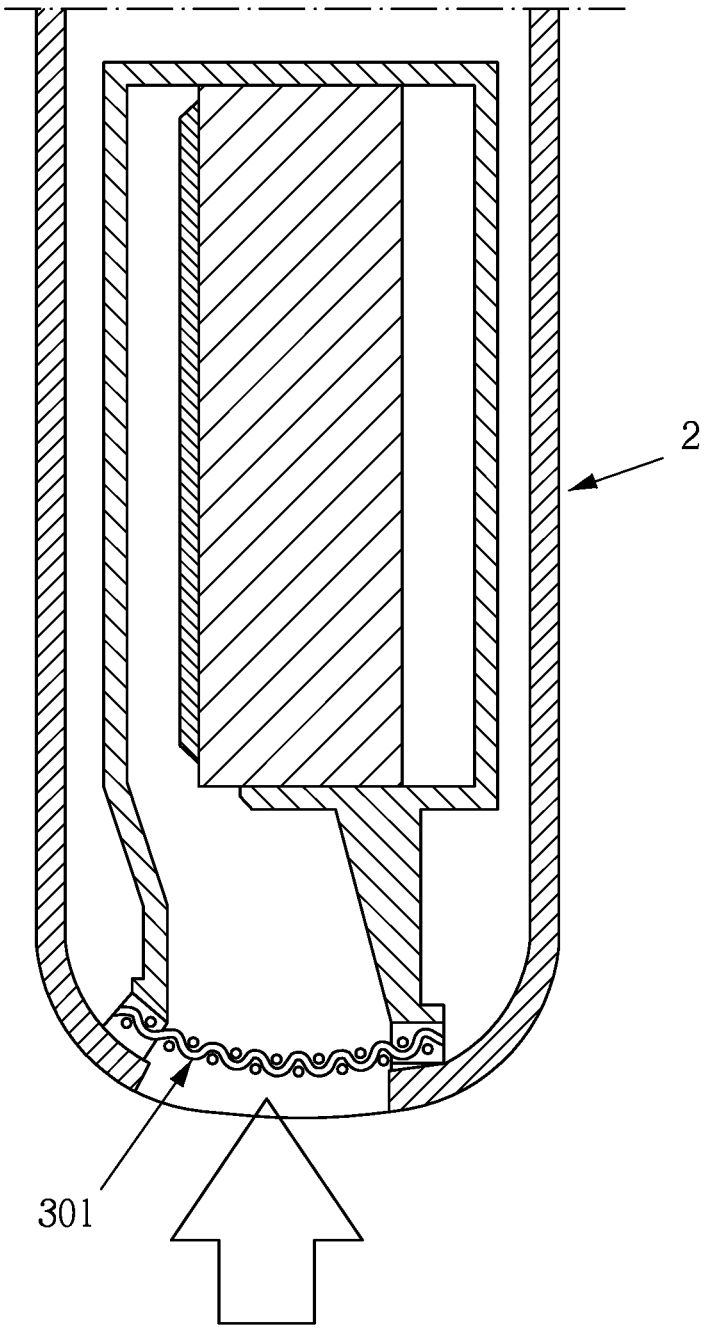
FIG. 26 is a partial cross-sectional view of a smartphone illustrating the component according to the present invention arranged according to a curved surface.

According to a further aspect of the present invention, the die-cut part, designated by the reference numeral 301, is set according to a curved surface, in the case where the conformation of the outer shell of the phone 2 so requires, as exemplified in FIG. 26.

In addition, other constructional solutions are here contemplated to obtain the assembling of the die-cut part with the two fabrics having different functions. In addition to the biadhesive already mentioned, gluing and plastic co-moulding are possible, where the two fabrics can be incorporated in a supporting frame, or else in the outer shell of the device, or else again in the speaker module already during the step of moulding of the component made of plastic material, through insertion of appropriate inserts made of fabric at the openings in the aforesaid components.

In addition to the main use for draining of the speaker module of smartphones, the present invention may in general be applied in all the areas where a water-tight speaker is present, for example also the earpiece of the phone.

In addition to waterproof smartphones, the invention may be applied to all water-resistant devices with IP67/68 characteristics and having water-tight speakers, which require rapid draining of the water that has penetrated in the vicinity of the speakers themselves. By way of non-exhaustive example, this family of products also comprises waterproof versions of tablets, smartablets, notebooks, laptops, and satellite-navigation systems.

Practical Implementation: Exemplary Case with Experimental Results

In order to verify the advantages of the innovative solution proposed herein, an experimental test was conducted using a speaker module taken from a commercially available smartphone of IP68 class, manufactured in Q1/2017.

The component was subjected to forced filling with water and subsequent emptying by shaking, measuring the weight thereof and hence also the amount of residual water remaining inside as a function of the number of shakes applied for removing the liquid.

Figure 27:
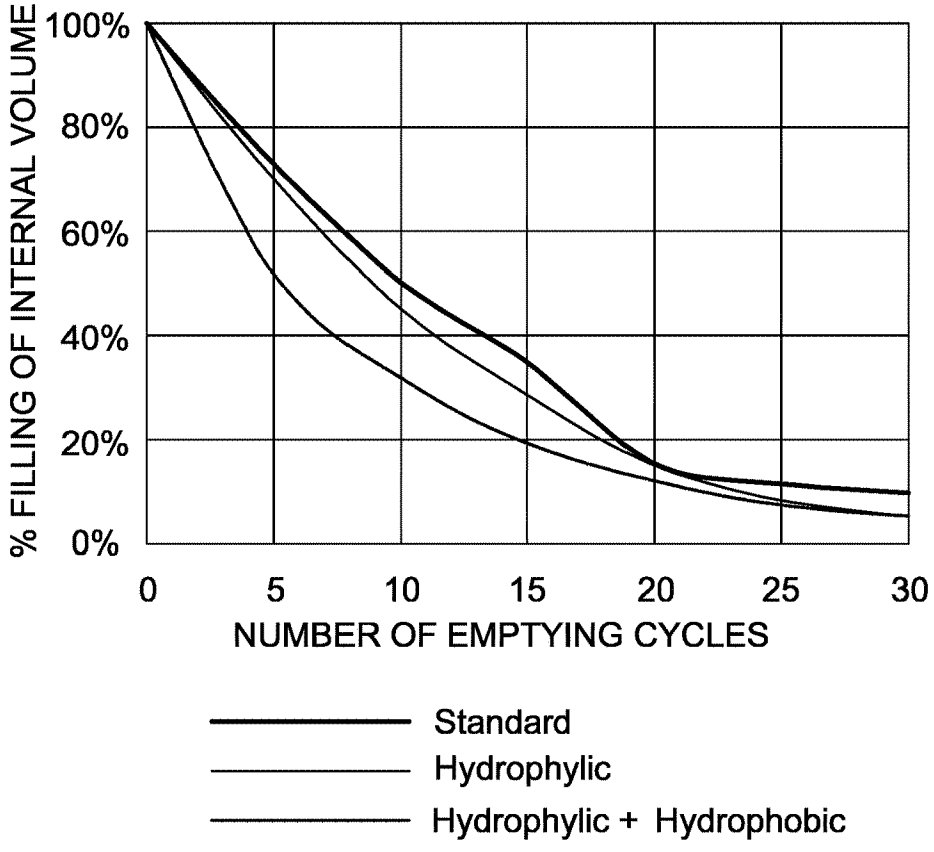
FIGS. 27 and 28 show two graphs that give the experimental results obtained by subjecting the component to a forced filling with water and subsequent emptying by shaking it.
Figure 28:
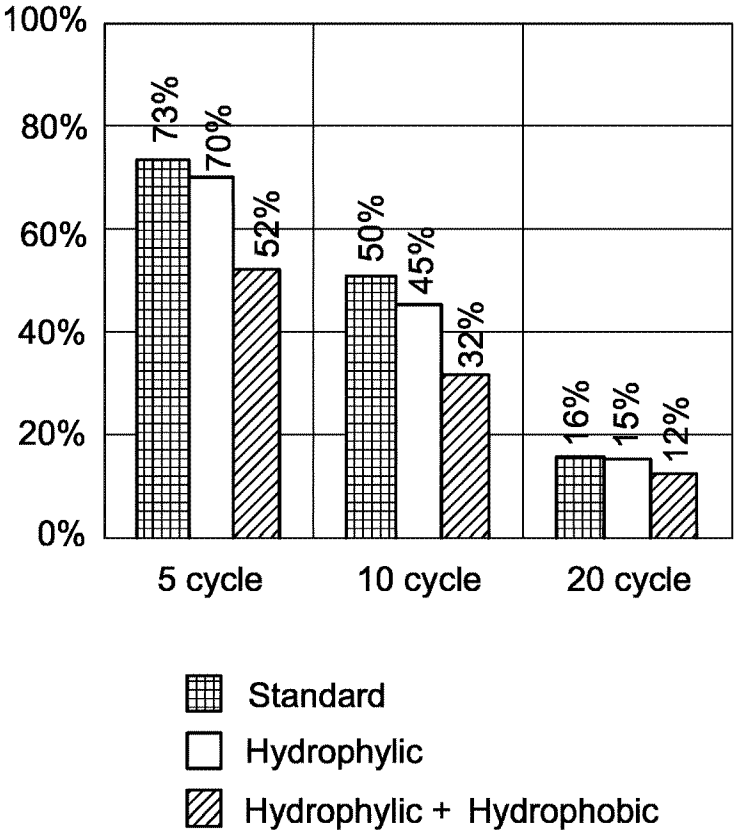

FIGS. 27 and 28 show two graphs that present the experimental results obtained.

The speaker module has dimensions typical for this type of devices, with a free volume in front of the speaker of approximately 140 $mm^3$ and an acoustic channel with section of passage of 10×1.6 mm in a position corresponding to the die-cut part. In front of this position there are then three oval openings measuring 3×1.6 mm on the outer body of the device.

The testing was repeated using three different embodiments of the die-cut part, all based upon a monofilament polyester technical fabric having the same geometry, with 55 filaments/cm and a filament diameter of 64 μM.

The surface treatment was, instead, modified as described hereinafter.

In the first test, standard technical fabric without coating was used, without hydrophobic or hydrophilic characteristics, this choice normally being applied for a great amount of smartphones produced.

In the second test, the die-cut part was obtained integrally with the hydrophilic technical fabric. This corresponds to a possible improvement for a more effective removal of water.

The third test regards the present invention: the die-cut part was formed by keeping the hydrophilic fabric exposed over two thirds of the surface of passage, whereas the remaining portion was covered by hydrophobic fabric to favour inlet of air that facilitates draining.

It should be noted, instead, that no test was carried out on the alternative of a completely hydrophobic fabric, which, by its very nature, is manifestly worse as regards draining of water.

As can be seen from the graphs of FIGS. 27 and 28, the present invention maximises the rate of emptying of the speaker module, there having been found amounts of residual water always lower than in the other two cases, for any number of emptying cycles.

It should moreover be noted that the excellent results referred to above would have been even better if the polymeric material of the speaker module had been less hydrophilic and had held less water within the module itself. An optimisation in this sense would guarantee an ideal functionality of the present invention, which, however, shows even now an emptying and draining capacity better than those existing in the prior art (standard technical fabrics) or that are likely to exist in the immediate future (hydrophilic technical fabrics over the entire surface of the die-cut part).

Waterproof smartphones and electronic devices are able to withstand without any problem prolonged immersion in water, but when they are taken out of the water, their speakers are flooded in the external volumes, losing the acoustic functionality almost completely.

This capacity would be recovered only after various hours of natural drying, which is not normally acceptable. Consequently, forced draining must be carried out by vigorous shaking of the device, which should desirably be as brief as possible.

As has been demonstrated experimentally, the cycles of shaking to obtain draining are minimised thanks to the present invention. The combination of hydrophilic and hydrophobic technical fabric, set alongside one another on a single component in the region of the sound port of the speaker, markedly facilitates the draining operation, thus recovering functionality of the device in a shorter time and with less effort on the part of the user.

Figure 29:
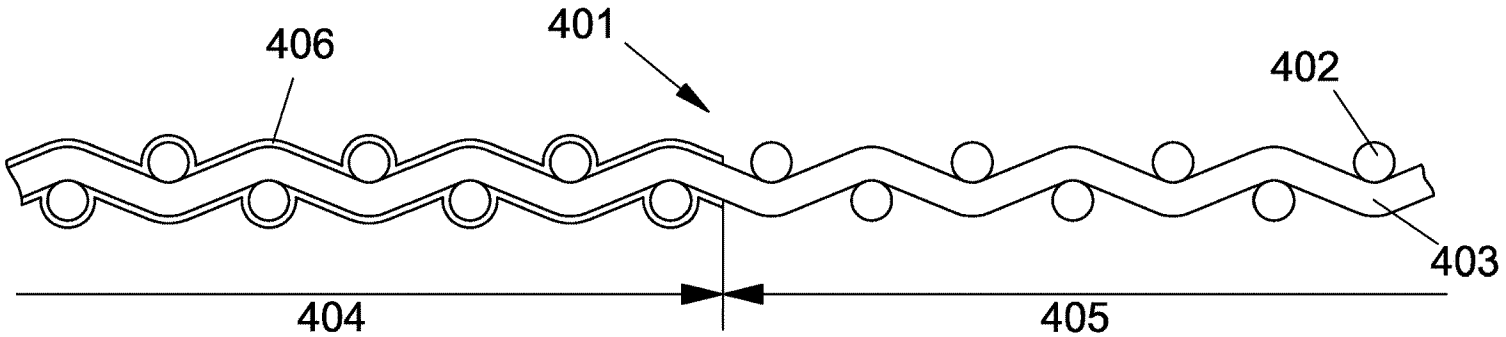
FIG. 29 is a cross-sectional view of the component constituted by a fabric, according to a further aspect of the invention.

FIGS. 29-37 illustrate a component according to a further aspect of the invention, designated as a whole by 401 in FIG. 29, which is constituted by a technical fabric obtained by weaving warp 402 and weft 403 of a synthetic monofilament.

The fabric 401 has areas 404 distinguished by a high degree of wettability, and areas 405 with a lower degree of wettability.

According to this further aspect of the invention, the area 404 with high wettability has a hydrophilic nature, corresponding to values of angle of contact (active analysis of the drop deposited, with volume of the droplet of 4 μl; liquid: water; sessile-drop technique) of less than 60°, preferably 30° to 40°.

The area 405 of the fabric 401 that has lower wettability, has instead a prevalently hydrophobic behaviour, corresponding to an angle of contact greater than 90° in the same measurement conditions specified previously, or in any case greater than the angle measured in the areas 404 with high degree of wettability.

To obtain this differentiation of characteristics of the aforesaid areas 404 and 405, a fabric 401 is initially made of a synthetic monofilament, preferably of an intrinsically hydrophobic, or in any case not particularly wettable, polymer. Preferred for the invention are the polymers PET, PEEK, PVDF, PPS, LEN, PFA, PA, PP, PTFE, PI.

During the finishing process, the fabric thus obtained is subjected to a surface coating treatment with a hydrophilic chemical agent, typically applied by dipping, so as to form a thin layer 406 of hydrophilic coating, adherent to the aforesaid filaments 402, 403 over the entire surface of the starting fabric. Next, the method of the invention envisages a step of selective ablation of the coating (for example, of a laser or chemical type, or of some other type), limited to the surface of the area 405 in which it is desired to obtain low wettability. The fabric 401 according to the invention is thus obtained, characterized by the presence, on its continuous surface, of the aforesaid areas 404 and 405 with different degrees of wettability.

Figure 30:
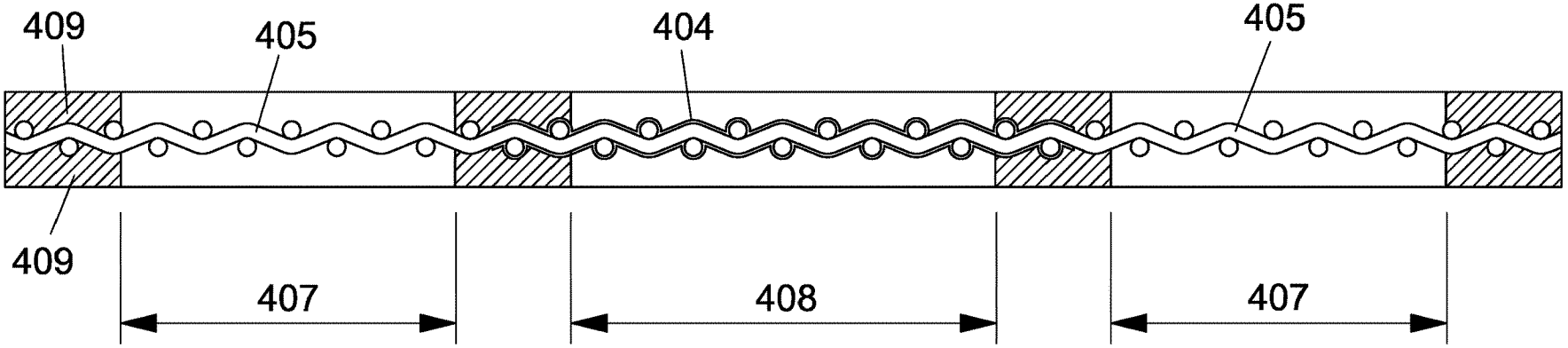
FIG. 30 is a cross section of the die-cut part.

With reference to a configuration with multiple sound ports, as illustrated in FIG. 30 (similar to FIG. 19 of the previously described embodiment), the fabric 401 of the invention is applied so as to get the areas 405 with low wettability to coincide with the sound ports 407 and the areas 404 with a high wettability to coincide with the sound port 408. The same configuration is obtained by assembling the fabric 401 of the invention to obtain a die-cut part similar to the die-cut part of FIG. 16, with the aid of biadhesive frames 409 on both faces. Assembly is carried out so as to respect the geometry of the smartphone of FIG. 19.

Figure 2:
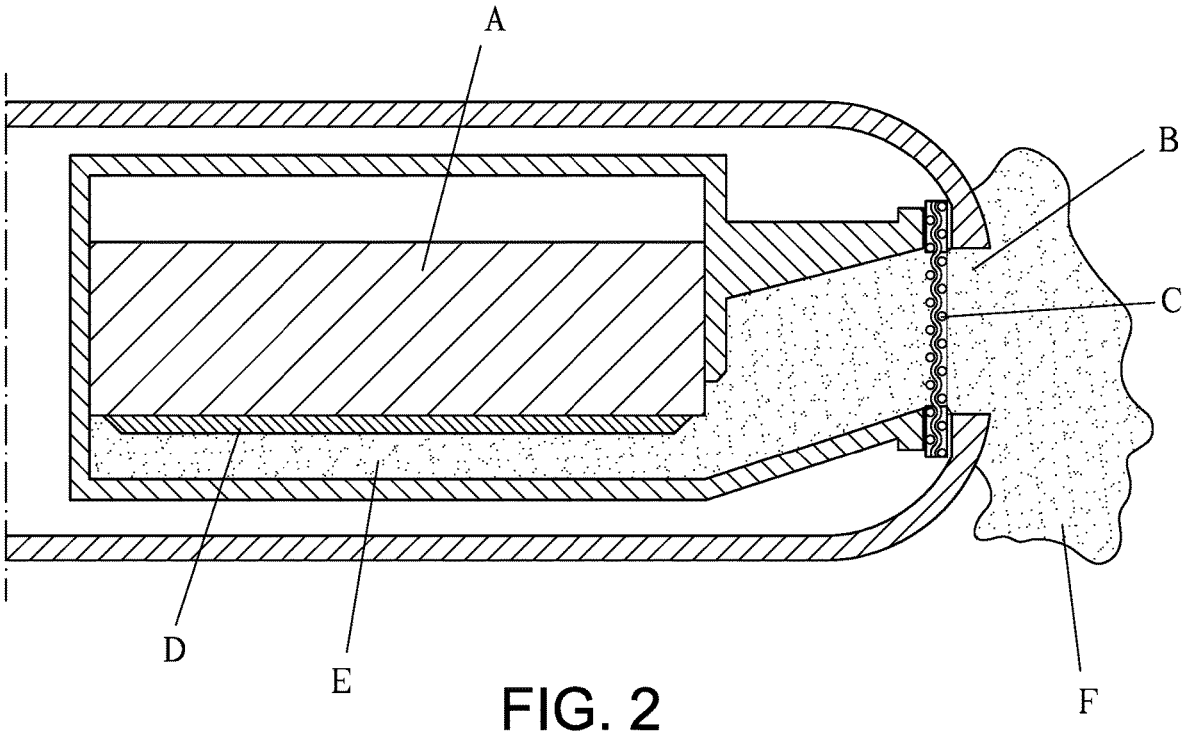
FIG. 2 PRIOR ART
FIG. 2 is a cross-sectional view of a water-resistant conventional smartphone with degree of protection IPx7 or higher, showing the area where the water-tight speaker is installed.
Figure 3:
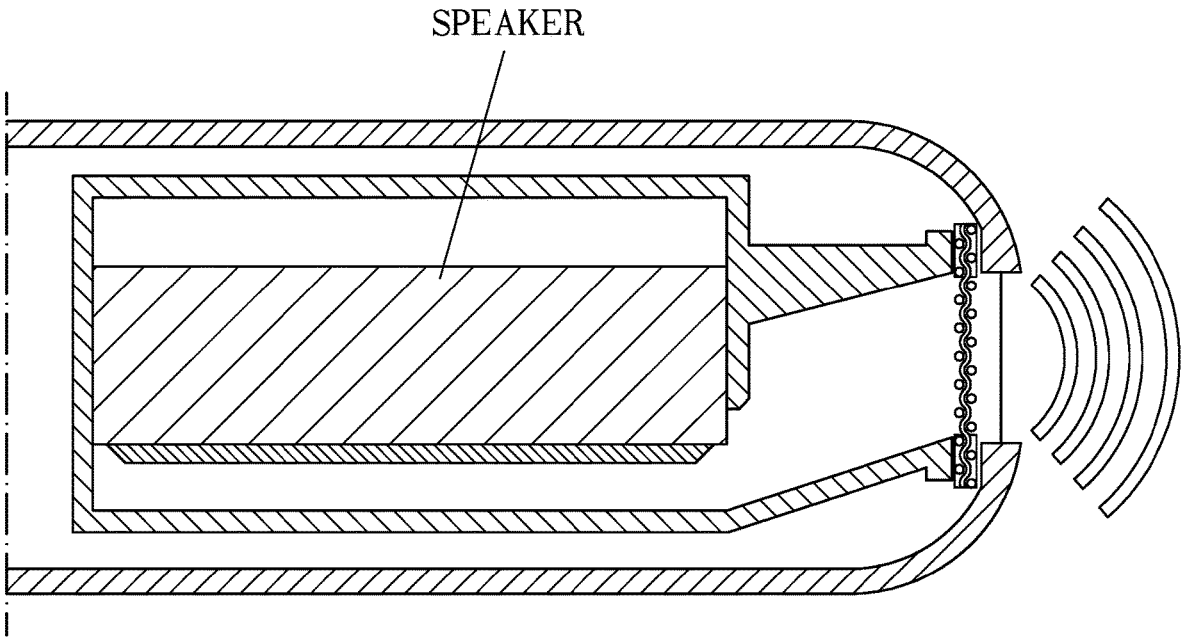
FIG.3 PRIOR ART
FIG. 3 is a cross-sectional view of a conventional smartphone with side-firing configuration.
Figure 4:
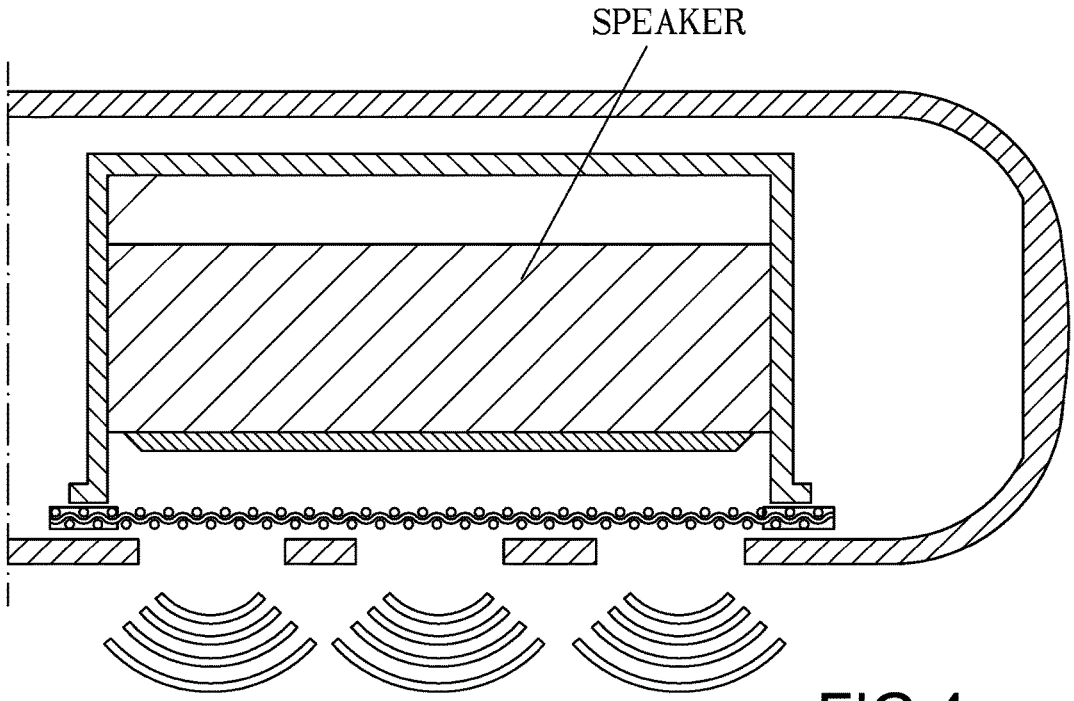
FIG.4 PRIOR ART
FIG. 4 is a cross-sectional view of a conventional smartphone with rear-firing configuration.
Figure 10:
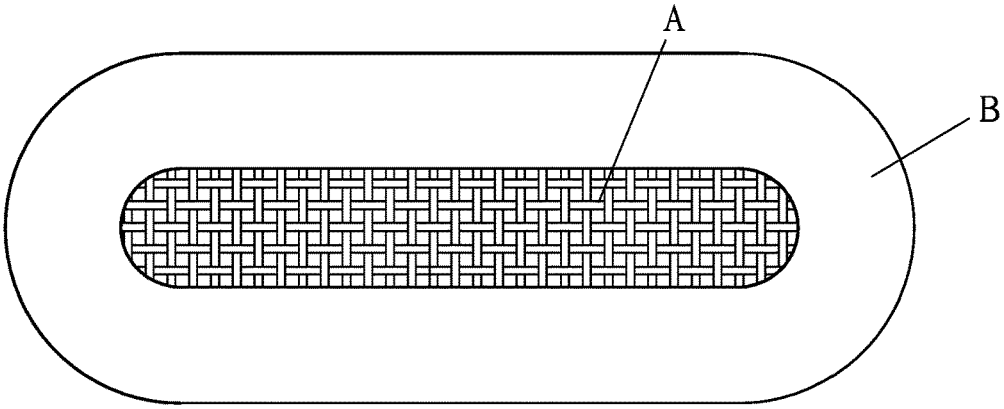
FIG.10 PRIOR ART
FIG. 10 is a front view of a conventional die-cut part.
Figure 11:
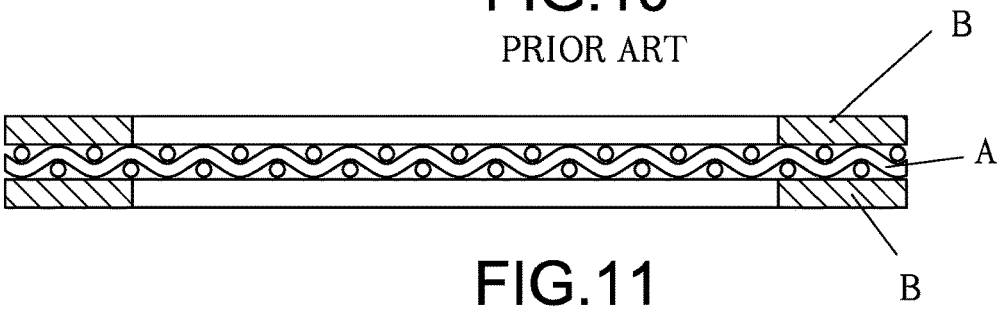
FIG.11 PRIOR ART
FIG. 11 is a lateral sectional view of a conventional die-cut part.
Figure 12:
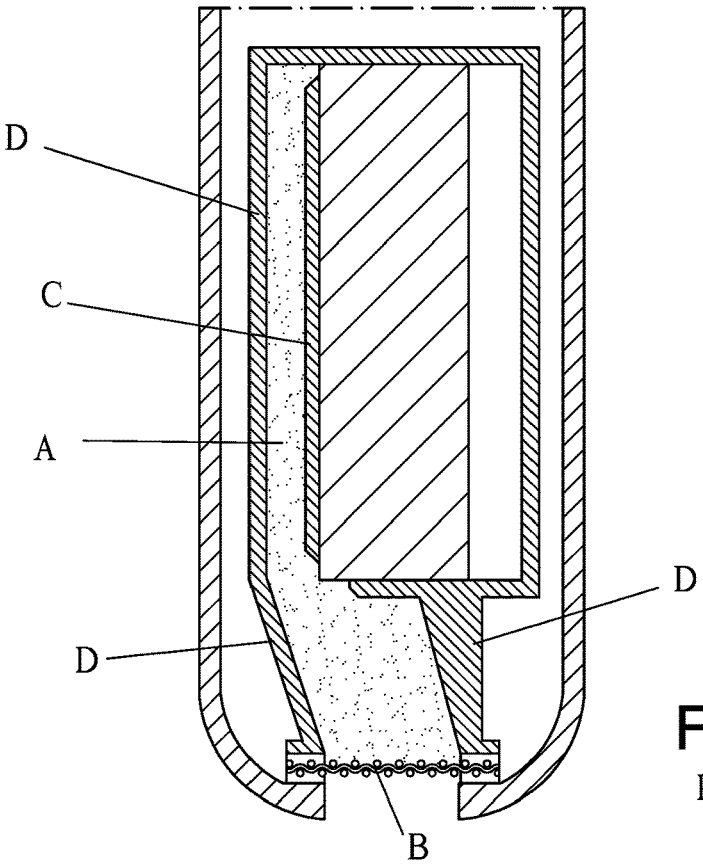
FIG.12 PRIOR ART
FIG. 12 is a cross-sectional view of a hypothetical conventional smartphone in the area of the speaker module.
Figure 13:
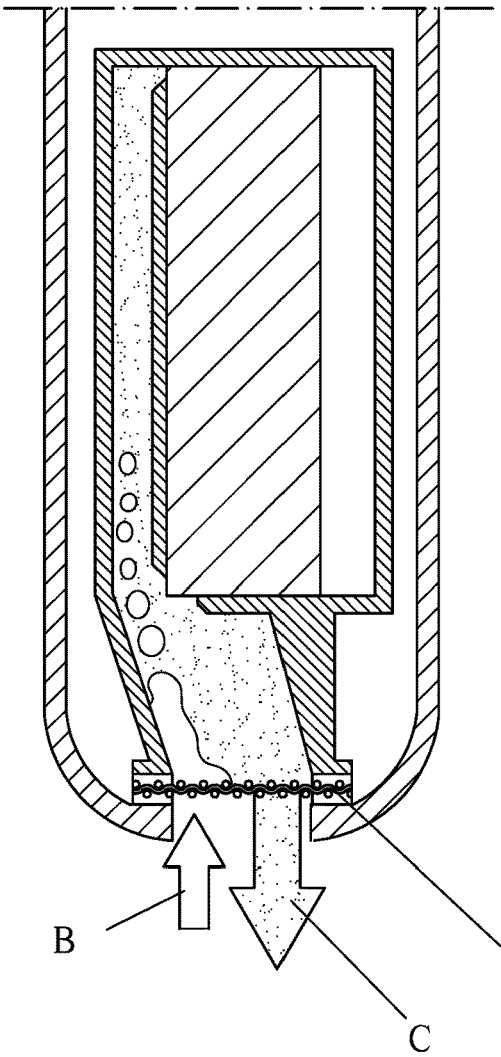
FIG. 13 is a cross-sectional view of a conventional smartphone provided with a die-cut part for the protection of a sound port, showing the desirable behaviour for expulsion of the water (this is the ideal condition, which, however, is not achieved with the solutions according to prior art but is the aim of the present invention)

In the case of accidental dropping of the phone in deep water, the water passes through the fabric 401 and is stopped at the level of the diaphragm D of the speaker of FIG. 2, flooding the internal volume E in front of the speaker.

Figure 31:
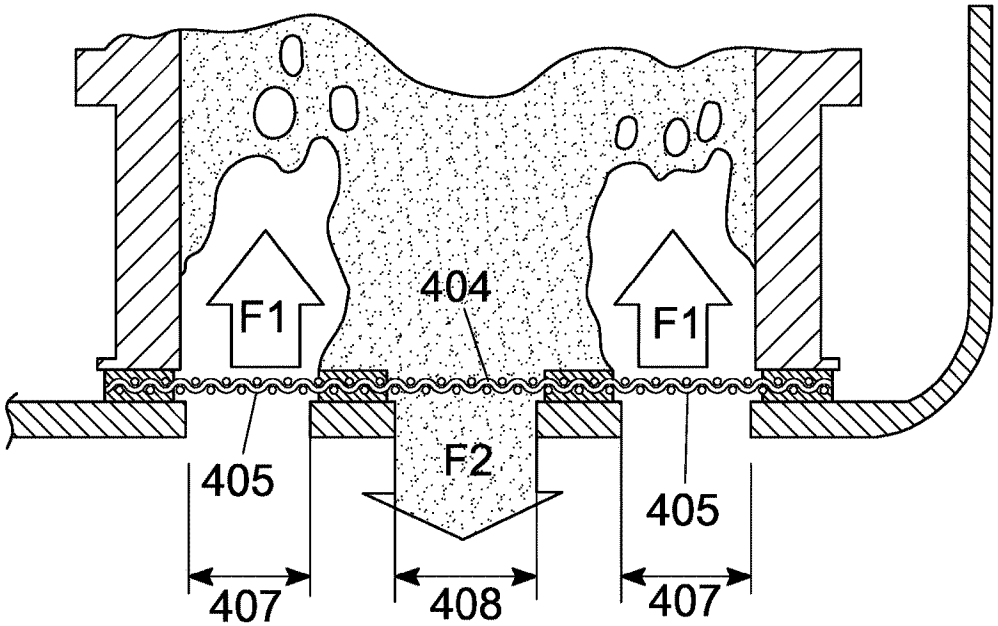
FIG. 31 illustrates the operating principle of the fabric of the invention, as installed on a die-cut part with just one sound port.
Figure 32:
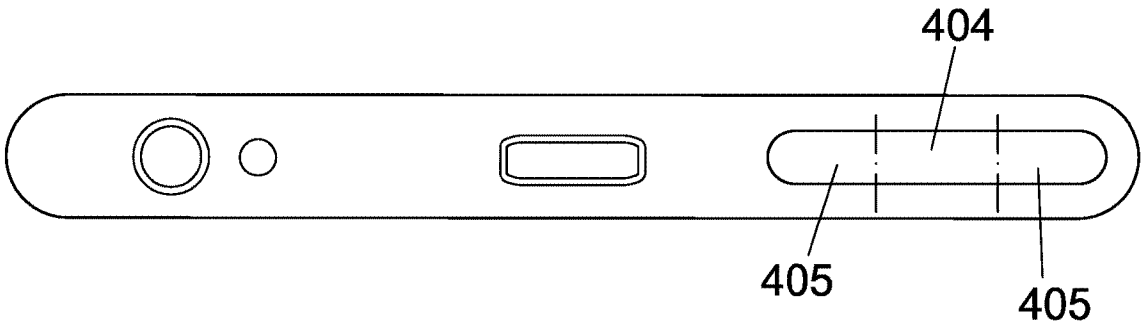
FIG. 32 illustrates a variation of the smartphone of FIG. 19, in the case of a single sound port.
Figure 33:
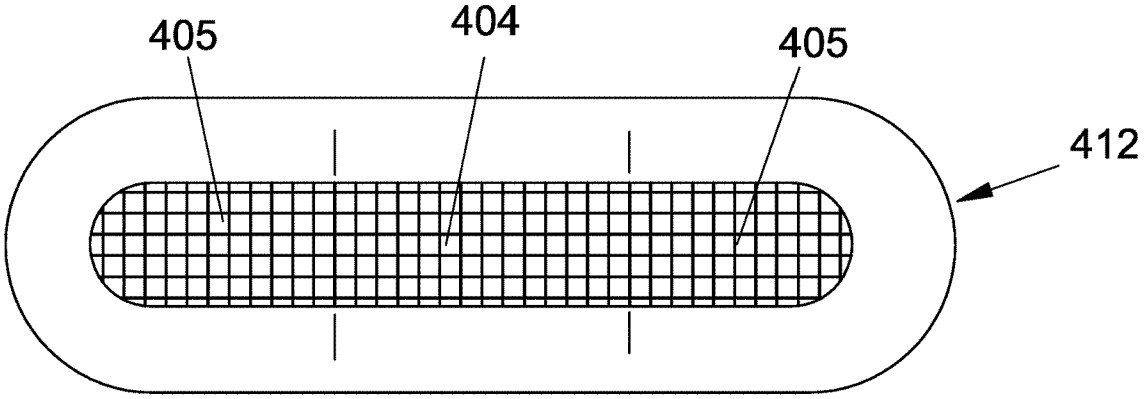
FIGS. 33 and 34 illustrate a variation of the previous FIGS. 20 and 30, compatible with the smartphone of FIG. 32.
Figure 34:
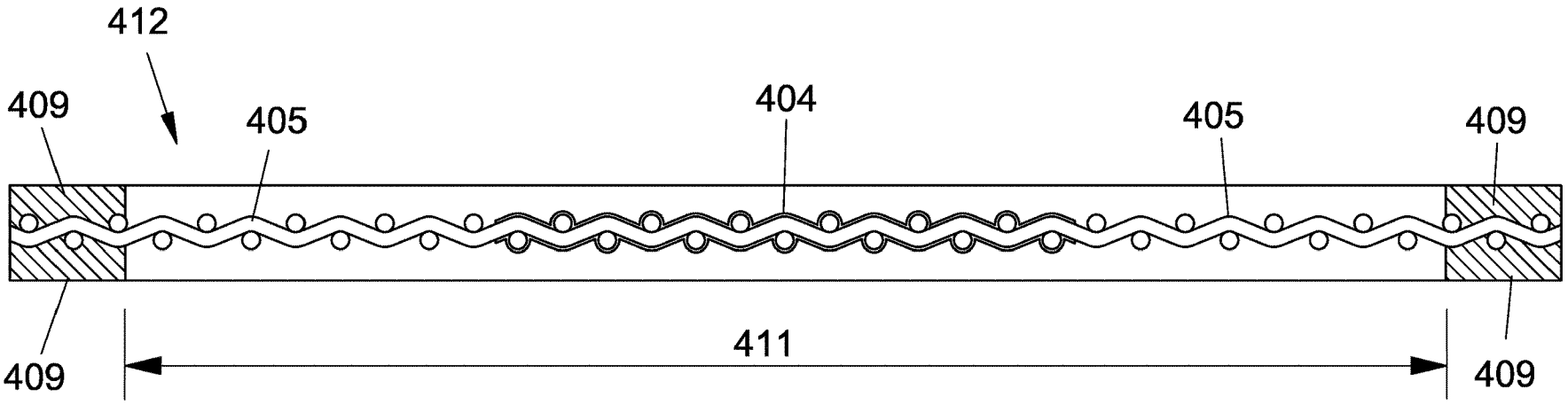

Subsequent draining, which is obtained by emptying the device, thanks to the invention is facilitated in the way described hereinafter. The area 404 with a higher wettability guarantees regular off-flow of water (flow F2 of FIG. 31), thus emptying the internal volume of the speaker. Emptying is favoured by simultaneous entry of air in the same volume E, which replaces the volume of the water that exits. This flow, designated by F1 in FIG. 31, is favoured by the lower wettability of the areas 405 of fabric 401, compared to the area 404 with a higher wettability. The areas 405, which tend to dry more, in fact facilitate entry of the air flow F1.

The principle referred to above applies not only to the example with three sound ports illustrated in FIGS. 20, 30, and 31, but in general to a smartphone configuration provided with multiple sound ports.

The invention may likewise be applied also to the case of a smartphone having just one sound port, according to the variation illustrated in FIGS. 32 to 35. In this case, the fabric 401 is applied to the die-cut part 412 of FIGS. 33 and 34, distinguished by the presence of just one opening, corresponding to the entire sound port 411 of the phone, underneath which the fabric 401 is applied, which covers both the area 404 with higher wettability and the area 405 with lower wettability.

Figure 35:
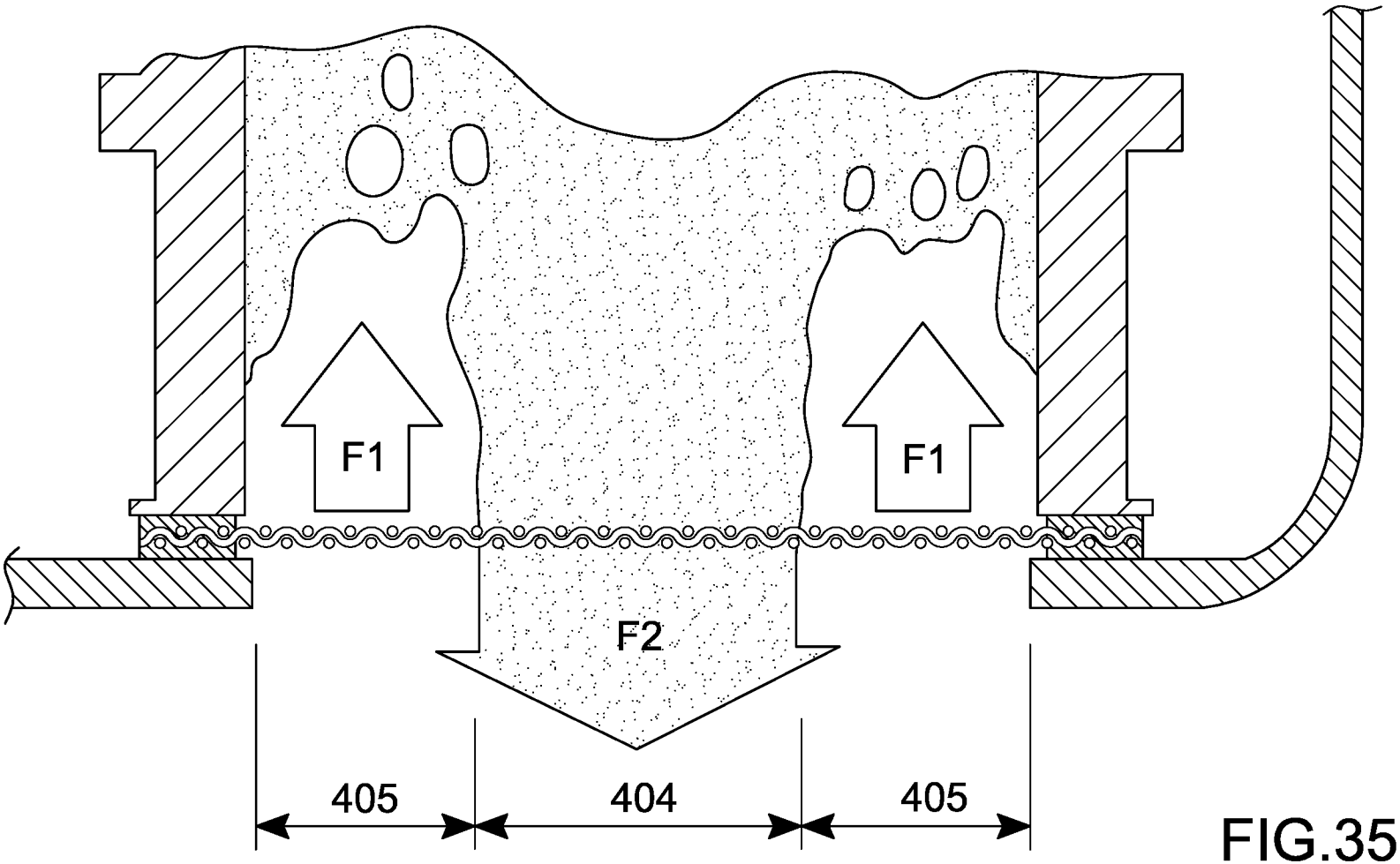
FIG. 35 illustrates the operating principle of the fabric mounted on the die-cut part of FIGS. 33 and 34 installed on the smartphone of FIG. 32.

As illustrated in FIG. 35, in the embodiment with a single sound port the operating principle remains the one already described previously, expect that just one port is present, closed by the fabric according to the invention and through which the flow F2 of outgoing water and the flow F1 of incoming air occur simultaneously.

According to a further aspect of the present invention, the fabric 401 is arranged according to a curved surface in the case where the conformation of the outer shell of the phone so requires, in a way similar to the die-cut part, designated by the reference numeral 301 of FIG. 26 of the previous embodiment.

In addition to the main use for draining the speaker modules of smartphones, the present invention may in general be applied in all the positions in which a water-tight speaker is present, for example also the earpiece of the phone.

In addition to waterproof smartphones, the invention also applies to all waterproof devices with IP67/68 characteristics having water-tight speakers that require fast draining-off of the water that has penetrated in the vicinity of the speakers themselves. By way of non-exhaustive example, this family of products also comprises waterproof versions of tablets, smartablets, notebooks, laptops, and satellite-navigation systems.

Practical Implementation: Exemplary Case with Experimental Results

In order to verify the advantages of the innovative solution proposed herein, a test was conducted using a speaker module taken from a commercially available smartphone of IP68 class, manufactured in Q1/2017.

The component was subjected to forced filling with water and subsequent emptying by shaking, measuring the weight thereof and hence also the amount of residual water remaining inside as a function of the number of shakes applied for removing the liquid.

Figure 36:
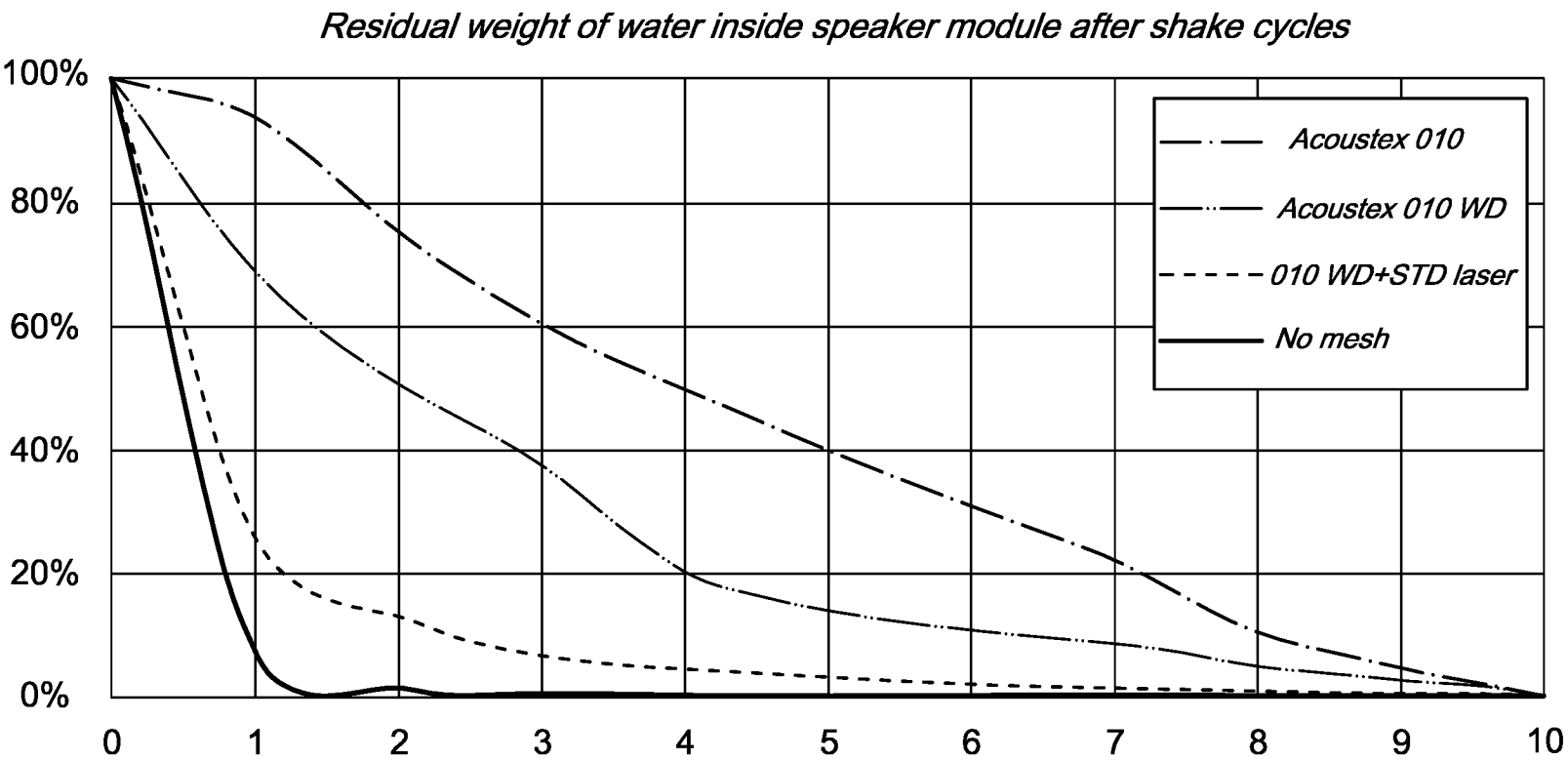
FIGS. 36 and 37 show two graphs that give the experimental results obtained by subjecting the component of the invention to forced filling with water and subsequent emptying by shaking it.
Figure 37:
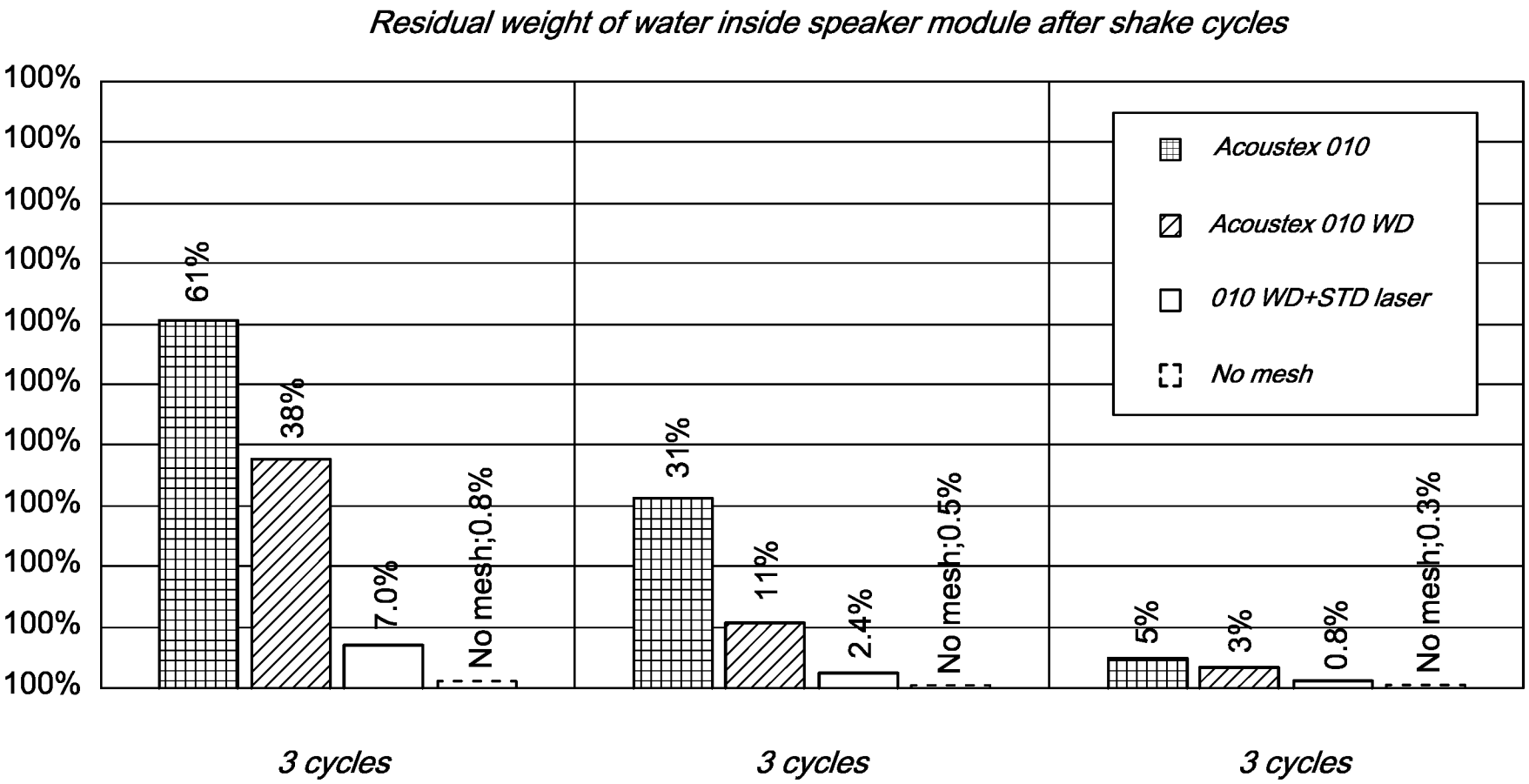

FIGS. 36 and 37 show two graphs that give the experimental results obtained.

The speaker module has dimensions typical for this type of devices, with a free volume in front of the speaker of approximately 140 $mm^3$ and an acoustic channel with section of passage of 10×1.6 mm in a position corresponding to the die-cut part. In front of this position there are then three oval openings measuring 3×1.6 mm on the outer body of the device.

The testing was repeated using three different embodiments of the die-cut part, all based upon a monofilament polyester technical fabric having the same geometry, with 55 filaments/cm and a filament diameter of 64 μm.

The surface treatment was instead modified as described hereinafter.

In the first test, a standard technical fabric without coating was used, without hydrophobic or hydrophilic characteristics, this choice normally being applied for a great amount of smartphones produced.

In the second test, the die-cut part was obtained integrally with the hydrophilic technical fabric. This corresponds to a possible improvement for a more effective removal of water.

In the third test, the die-cut part was made with the fabric according to the present invention, i.e., a fabric with areas with different wettability. The areas with different wettability were obtained via a dip-coating process such as to render the entire surface of the fabric particularly wettable and via subsequent partial removal of the hydrophilic coating, by means of a laser-ablation process.

As can be seen from the graphs of FIGS. 36 and 37, the present invention maximises the rate of emptying of the speaker module, there having been measured residual amounts of water always smaller than in the other two cases, for any number of emptying cycles.

Waterproof smartphones and electronic devices are able to withstand without any problem prolonged immersion in water, but when they are taken out of the water, their speakers are flooded in the external volumes, losing the acoustic functionality almost completely.

This capacity would be recovered only after various hours of natural drying, which is not normally acceptable. Consequently, forced draining must be carried out by vigorous shaking of the device, which should desirably be as brief as possible.

As has been demonstrated experimentally, the cycles of shaking to obtain draining are minimised thanks to the synthetic monofilament based fabric of the present invention with mesh apertures having a size of between 20 and 300 μm.

In particular, the present fabric can be advantageously used for speakers of smartphones, smartablets, and tablets with waterproofing characteristics of IPx7 degree or higher having water-tight speakers in order to guarantee optimal draining-off of the water that has penetrated into the spaces close to the water-tight speakers.

The present fabric may moreover be advantageously used for speaker modules in side-firing configuration installed on smartphones that present waterproofing characteristics of IPx7 degree or higher and have water-tight speakers.

It has in practice been noted that the invention achieves the intended aim and objects.

There is in fact obtained a shaped component particularly studied for providing protection and ensuring draining-off of the water from the speakers of electronic devices with waterproofing characteristics of IPx7 degree or higher and having water-tight speakers, comprising within it at least one opening at which a synthetic technical fabric with hydrophilic treatment or coating is installed in order to guarantee rapid exit of the water that has previously entered the volume in front of the speaker, and at least one other opening at which a synthetic technical fabric with hydrophobic treatment or coating is installed in order to favour entry of air into the volume in front of the speaker thus ensuring proper emptying thereof.

The component according to the present invention advantageously has two sections made of a synthetic monofilament based technical fabric with mesh apertures with size of between 20 and 300 μm and having hydrophilic characteristics and hydrophobic characteristics, respectively, obtained by means of coating or another surface treatment.

According to the present invention, the component is preferably obtained by cold dinking (die-cut part) and comprises one or more biadhesive layers to guarantee proper positioning thereof in the vicinity of the sound port of the speaker.

The die-cut part has biadhesive layers constituted by PSA (Pressure-Sensitive Adhesive) with a thickness of between 0.05 mm and 0.50 mm.

The die-cut part has five distinct functional layers: two layers of synthetic monofilament based technical fabric (hydrophilic and hydrophobic, respectively) alternating with three dinked biadhesive layers (105, 115, 125) so as to obtain at least two sections of passage with different functions, present in each of which is just the hydrophobic fabric or just the hydrophilic fabric.

In addition to the five functional layers already mentioned, the die-cut part may present further layers with accessory functions, such as polymeric sheets to guarantee greater stiffness or spongy material to provide better sealing.

The component according to the present invention may contain both hydrophilic technical fabric and hydrophobic technical fabric, and in its final use, if necessary, it may assume a curved configuration for following the particular shapes of the acoustic channel present on the outer body of the device to which it is applied.

According to a practical embodiment, the component is divided into two parts with different functions (hydrophilic and hydrophobic) applied in a position corresponding to the same speaker, the draining function being shared between two pieces used simultaneously.

In particular, the present component may advantageously be used for speakers of smartphones, smartablets, and tablets with waterproofing characteristics of IPx7 degree or higher and having water-tight speakers in order to guarantee optimal draining-off of the water that has penetrated into the spaces close to the water-tight speakers.

The present component may moreover be advantageously used for speaker modules in side-firing configuration installed on smartphones with waterproofing characteristics of IPx7 degree or higher and having water-tight speakers.

Of course, the materials used, as well as the dimensions, may be any according to the requirements.

The invention claimed is:

1. A component having the function of draining water from speakers in a waterproof electronic device, comprising a synthetic technical fabric (1, 101, 201, 301, 401) having areas (3, 103, 404, 4, 104, 405) with different degrees of wettability; said component being characterized in that it comprises areas having a hydrophilic nature (3, 103, 404) and areas having a prevalently hydrophobic nature (4, 104, 405); said component having at least two openings (3, 103, 404, 4, 104, 405): a first opening corresponding to said areas having a hydrophilic nature (3, 103, 404), and a second opening corresponding to said areas having a hydrophobic nature (4, 104, 405); said areas having a hydrophilic nature (3, 103, 404) allowing exit of water previously entered through said first opening; said areas having a hydrophobic nature (4, 104, 405) allowing entry of air through said second opening to ensure the exit of water through said first opening.

2. The component, according to claim 1, characterized in that it comprises at least two sections (103, 104) made of synthetic monofilament based technical fabric with mesh apertures having a size of between 20 and 300 μm and having hydrophilic characteristics (103) and hydrophobic characteristics (104), respectively.

3. The component, according to claim 1, characterized in that it comprises one or more biadhesive layers (105, 115, 125).

4. The component, according to claim 3, characterized in that said biadhesive layers are constituted by PSA (Pressure-Sensitive Adhesive), with a thickness ranging between 0.05 mm and 0.50 mm.

5. The component, according to claim 2, characterized in that it comprises five distinct functional layers: a layer of said hydrophilic synthetic monofilament based technical fabric (103) and a layer of said hydrophobic synthetic monofilament based technical fabric (104) alternating with three die-cut biadhesive layers so as to obtain at least two areas of passage with different functions, in each of which is present just the hydrophobic fabric or just the hydrophilic fabric.

6. The component according to claim 5, characterized in that it comprises further layers, with accessory functions, made of polymeric sheets.

7. The component according to claim 1, characterized in that it has a curved configuration (301) to follow the shape of said electronic device at said openings.

8. The component, according to claim 1, characterized in that said areas having a hydrophilic nature (404) have a hydrophilic nature corresponding to values of angle of contact of less than 60°.

9. The component, according to claim 1, characterized in that said areas having a hydrophilic nature (404) have a hydrophilic nature corresponding to values of angle of contact of between 30° and 40°.

10. The component, according to claim 1, characterized in that said areas having a hydrophobic nature (405) have a prevalently hydrophobic nature corresponding to an angle of contact greater than 90° or in any case greater than the angle measured in said areas having a hydrophilic nature (404).

11. The component, according to claim 1, characterized in that said fabric is a synthetic monofilament based fabric, made of intrinsically hydrophobic, non wettable, polymer.

12. The component, according to claim 1, characterized in that said fabric is a synthetic monofilament based fabric chosen among the polymers PET, PEEK, PVDF, PPS, LEN, PFA, PP, PA, PTFE, and PI.

13. The component, according to claim 1, characterized in that it comprises a layer of hydrophilic coating (406) adherent to the surface of the fabric, except for said areas with a low degree of wettability (405).

14. The component, according to claim 1, characterized in that said fabric has mesh apertures with a size of between 20 and 300 μm.

15. The component, according to claim 1, characterized in that said fabric (401) is assembled in the form of a die-cut part (410) and completed with biadhesive frames (409) on both faces.

16. A method for the production of a technical fabric (401), having the function of draining off water from the speakers of a waterproof electronic device according to claim 1, characterized in that it comprises the steps of:

- weaving a synthetic monofilament made of intrinsically hydrophobic, non wettable, polymer;
- subjecting said fabric to a surface coating treatment with a hydrophilic chemical agent so as to form a layer (406) of hydrophilic coating adherent to said filaments (402, 403) over the entire surface of the starting fabric; and
- carrying out selective ablation of said coating, limited to the surface of said areas with a low degree of wettability (405).

17. A use of the component according to claim 1, for speakers of smartphones, smartablets, and tablets which have water-tight speakers, for draining off water that has penetrated in the spaces close to the water-tight speakers.

18. A use of the component according to claim 1, for speaker modules in side-firing configuration installed on smartphones having water-tight speakers.

* * * * *